United States Patent [19]

Le Covec

[11] Patent Number: 4,481,156

[45] Date of Patent: Nov. 6, 1984

[54] ATMOSPHERIC/LIQUID COOLER CONSTRUCTION

[75] Inventor: Jean Le Covec, Paris, France

[73] Assignee: Hamon-Sobelco, S.A., Brussels, Belgium

[21] Appl. No.: 504,732

[22] Filed: Jun. 16, 1983

[30] Foreign Application Priority Data

Jul. 1, 1982 [FR] France ..... 82 11588

[51] Int. Cl.[3] ..... B01F 3/04

[52] U.S. Cl. ..... 261/111; 52/245; 261/DIG. 11; 261/DIG. 85; 261/DIG. 86; 405/119

[58] Field of Search ..... 261/108–112, 261/DIG. 11, DIG. 85, DIG. 86; 405/119; 165/DIG. 1, 60; 52/245, 247, 11

[56] References Cited

U.S. PATENT DOCUMENTS

| | | | |
|---|---|---|---|
| 1,632,397 | 6/1927 | Fluor | 261/DIG. 11 |
| 2,907,554 | 10/1959 | Heller | 261/DIG. 11 |
| 3,243,166 | 3/1966 | Osenga et al. | 261/DIG. 11 |
| 3,903,212 | 9/1975 | Lefevre | 261/111 X |
| 4,032,604 | 6/1977 | Parkinson et al. | 261/111 |
| 4,261,931 | 4/1981 | Rothrock et al. | 52/247 X |
| 4,267,883 | 5/1981 | Maurice et al. | 261/DIG. 11 |
| 4,278,620 | 7/1981 | Lefevre | 165/DIG. 1 |
| 4,385,010 | 5/1983 | Bosne | 405/119 X |

FOREIGN PATENT DOCUMENTS

| | | | |
|---|---|---|---|
| 1635 | 8/1967 | Australia | 261/DIG. 11 |
| 362258 | 10/1922 | Fed. Rep. of Germany . | |
| 536882 | 10/1931 | Fed. Rep. of Germany . | |
| 876525 | 11/1942 | France . | |
| 1054296 | 2/1954 | France | 261/DIG. 11 |

*Primary Examiner*—Richard L. Chiesa

*Attorney, Agent, or Firm*—Kerkam, Stowell, Kondracki & Clarke

[57] ABSTRACT

A cooler employing air, as the cooling media, and a streaming liquid is of the type comprising a peripheral liquid receiving pan resting on piles which are independent and evenly spaced apart below the pan, a distribution system for a liquid to be cooled, a liquid-gas contacting unit extending under the distribution system and liquid receiving devices for the liquid including channels, disposed under the contacting unit, characterized in that the pan of the cooler rests on the piles through a wide peripheral lintel which supports an inner flange and an outer flange thereby defining a u-shaped member into which the cooled liquid collected in the channels is discharged by gravity.

6 Claims, 7 Drawing Figures

ATMOSPHERIC/LIQUID COOLER CONSTRUCTION

TECHNICAL FIELD

The present invention relates to a cooler employing atmospheric air to cool a streaming liquid.

The invention more particularly relates to a cooler using air to cool a streaming liquid of the type comprising a shell or tower structure having lower peripheral air inlet openings and, located within the shell, a distribution system for the liquid to be cooled, gas and liquid contacting units extending under the distribution system and devices for receiving the liquid including channels disposed under the gas and liquid contacting units.

BACKGROUND OF THE INVENTION

A cooler of this type has been disclosed in particular in French Pat. No. 876 525.

Coolers of this type have an application in particular in the cooling of water used in electric power generating stations. At the present time, in thee coolers, the shell in the shape of a tower rests on oblique pillars which are rigid with one another. Moreover, in these coolers, the water to be cooled arrives at the center of the tower and is collected, after streaming, by the channels which return the cooled water toward the center of the tower from which it is discharged.

The use of oblique pillars has not been found to be a completely satisfactory means for supporting cooling towers particularly in locations where the ground has an uneven stability, as differential subsidence is liable to occur which results in inclination of the tower.

It has been proposed to overcome this problem by the use of independent piles which are evenly spaced apart on the periphery of the tower. However, the presence of a central cooled water discharge pan limits the gas and liquid contacting zone and the supply of air under this zone. Central water discharge also gives rise to hydraulic problems in particular owing to the whirling of the collected liquid which tends to occur in the collecting pan.

Moreover, the presence of the central water discharge pan is a great hindrance to mounting of the contact devices inside the coolers and in maintenance operations.

Further, the location of the valves for by-passing liquid from the inlet of the hot water to the outlet of the cold water makes the valves difficult to reach.

BRIEF SUMMARY OF THE INVENTION

An object of the present invention is to overcome these various drawbacks.

The invention therefore provides an atmospheric cooler to cool a streaming liquid of the type comprising a shell resting on independent piles which are evenly spaced apart on the periphery and, disposed inside said shell, a distribution system for a liquid to be cooled, gas and liquid contacting units extending under the liquid distribution system and receiving devices for the liquid including channels disposed under the contacting unit, wherein the shell of the cooler rests on the piles through a wide peripheral lintel and a lower part of the shell may form an inner flange and an outer flange defining with the shell and lintel a peripheral pan in which the cooled liquid collected in the channels is discharged by gravity.

The use of a wide lintel bearing on the piles enables both improving the stability of the cooler and simplifying the construction and operation of the cooler.

In a particular embodiment of the present invention, the inner flange of the peripheral pan may be formed by the shell itself. In this case, the shell advantageously includes an inner peripheral tank communicating with the peripheral pan so as to receive the water streaming along the inner wall of the shell and to discharge it to the peripheral pan.

The shell may also rest on the peripheral lintel through pillars, the inner flange of the peripheral pan being then located within the cooler, namely within the vertical from the base of the shell, so as to collect the water streaming along the inner wall of the shell.

BRIEF DESCRIPTION OF THE DRAWING

The invention will be described hereinafter in more detail with reference to the drawings which show particular embodiments.

In the drawings

DETAILED DESCRIPTION OF THE INVENTION

Figure 1:
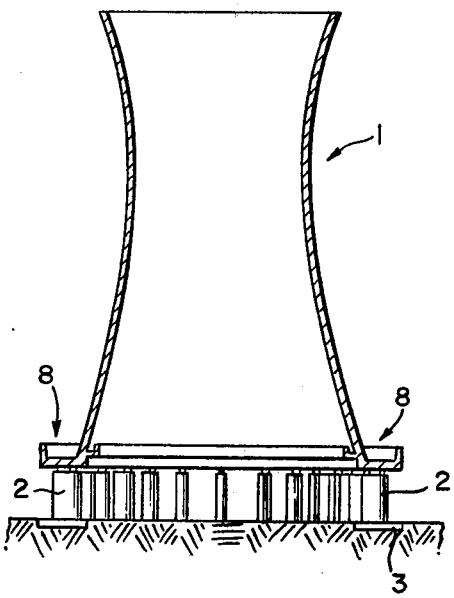
FIG. 1 is an elevational view of a cooling tower including the features of the present invention.
Figure 2:
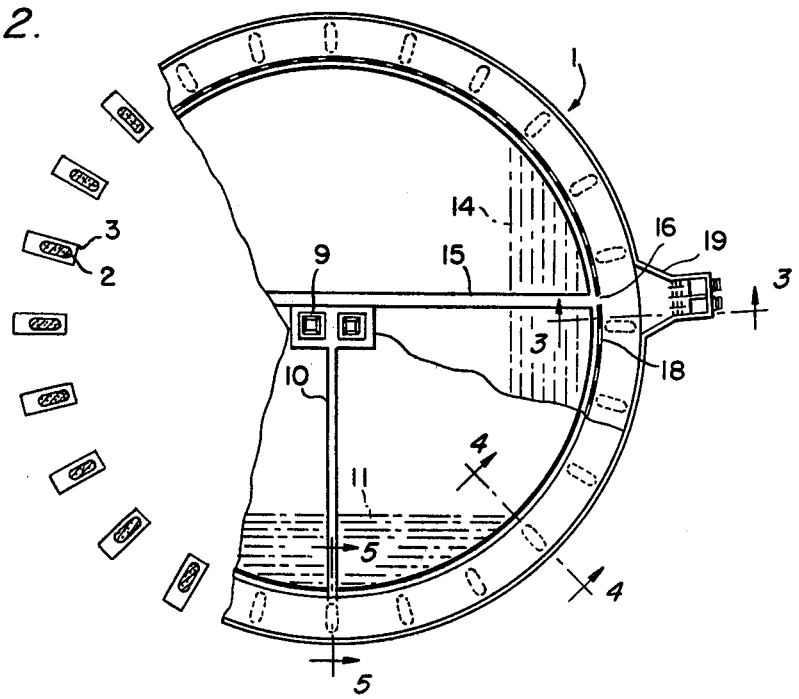
FIG. 2 is a horizontal sectional view at given levels of a cooler employing the air of the atmosphere according to the present invention.
Figure 4:
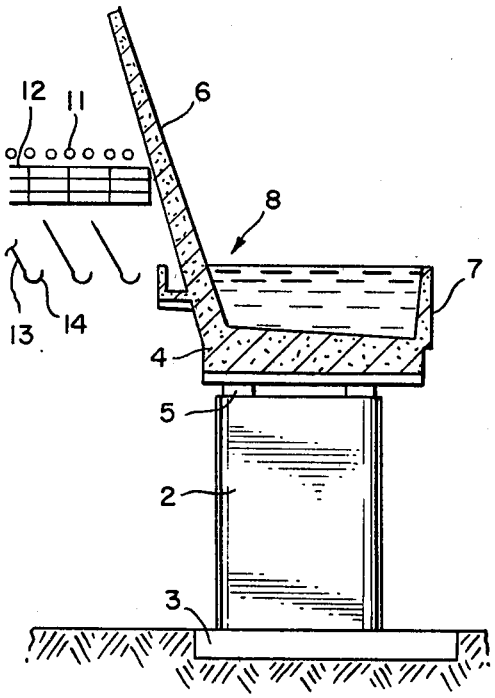
FIG. 4 is a sectional view taken on line 4—4 of FIG. 2.

FIGS. 1 and 2 show a cooler 1 employing, as the cooling media, air of the atmosphere according to the present invention. The cooling tower is shown in FIG. 2 in horizontal section, the section being taken at three different levels, namely: at the level of the piles, at the level of the channels and at the level of the distribution system of the liquid to be cooled.

The illustrated cooler 1 is in the shape of a hyperbolic torus and rests on a series of piles 2 which rest on bases or footers 3. The piles 2 are evenly spaced apart on the periphery of the cooler. In horizontal section, their largest dimension is oriented along the radii; their section comprises a central rectangular portion and terminates at the upstream and downstream sides (in respect to the direction of air flow) in rounded portions.

As shown in FIGS. 1 to 7, resting on all of the piles 2 is an annular lintel 4 which is slightly wider than the largest dimension of the piles in horizontal section. This very rigid lintel rests on the piles 2 through bearing blocks 5.

In the embodiment shown in FIGS. 2, 3, 4, 5 and 7, the lower part of the shell 6 of the cooler rests on the inner part of the lintel. The lintel 4 comprises at its upper part an outer flange 7 which forms with the lintel 4 and the lower part of the shell 6 a pan 8 which is adapated to collect the cooled liquid.

As shown in FIG. 2, the liquid to be cooled (usually water) is supplied from the ground level by way of two vertical pipes 9 which are located in the vicinity of the center of the cooler. The liquid supplied by pipes 9 then flows into two distribution channels (or galleries) 10 which are substantially horizontal and provided with lateral tubes 11 for distributing the liquid to be cooled. Each of the tubes 11 are provided with a large number of sray nozzles (now shown). Disposed under the distribution tubes 11 are elements 12 (of any conventional form such as filling sheets) for ensuring contact between the liquid to be cooled and the air which enters at the lower part of the cooler between the piles 2. Disposed under the fittings or elements 12 is a series of inclined walls 13 terminating in channels 14. The channels 14 are disposed in two slopes which causes the liquid to flow into a collector 15 passing through the center of the cooler. The collector 15 opens onto the peripheral pan 8 by way of an orifice 16.

A peripheral tank 17 is disposed on the inner wall of the shell substantially at the level of the channels 14 and communicates with the peripheral pan 8 by way of orifices 18.

Figure 3:
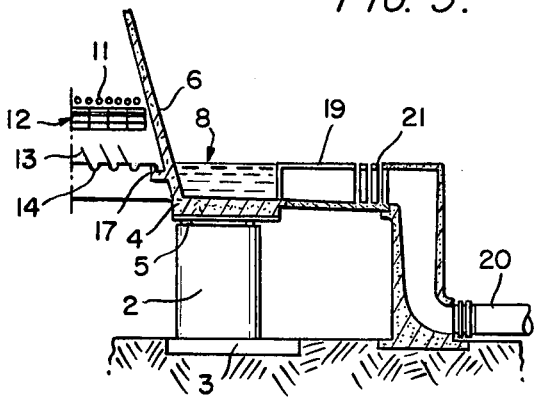
FIG. 3 is a sectional view taken on line 3—3 of FIG. 2.

As shown in FIGS. 2 and 3, the peripheral pan 8 has an outlet 19 for the cooled liquid disposed substantially in a radial extension of the collector. This outlet conducts the cooled liquid to a pipe 20. The outlet includes a cofferdam system 21 whereby it is possible to control the outlet of the cooled liquid from the peripheral pan 8.

Figure 5:
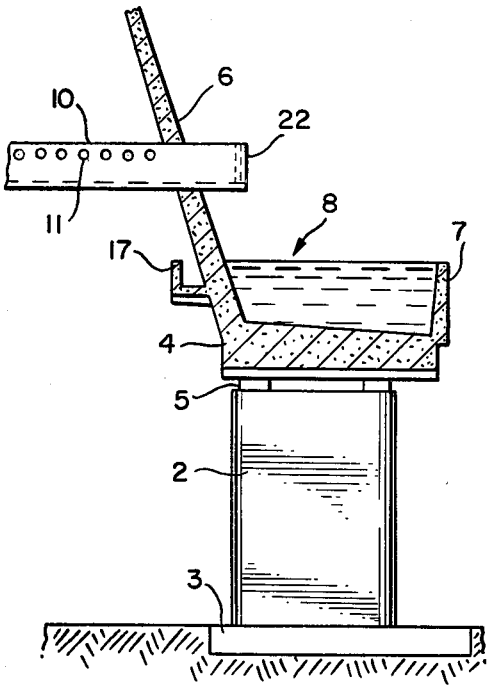
FIG. 5 is a sectional view taken on line 5—5 of FIG. 2.

As shown in FIGS. 2 and 5, the distribution channels 10 extend through the shell 6 and have their outlets disposed above the peripheral pan 8. The channels 10 may be provided with a by-pass valve 22 at their ends. The opening of valves 22 enables the liquid to be cooled to be discharged directly into the peripheral pan 8 so that the level of the liquid in channel 10 can be sufficiently lowered so as to no longer send the liquid to the distribution tubes 11. Such a by-pass is intended in particular to permit rapid stoppage of the flow of the water arriving on the elements 12 in the case of an intensely cold period so as to avoid the formation of ice on these elements.

Figure 6:
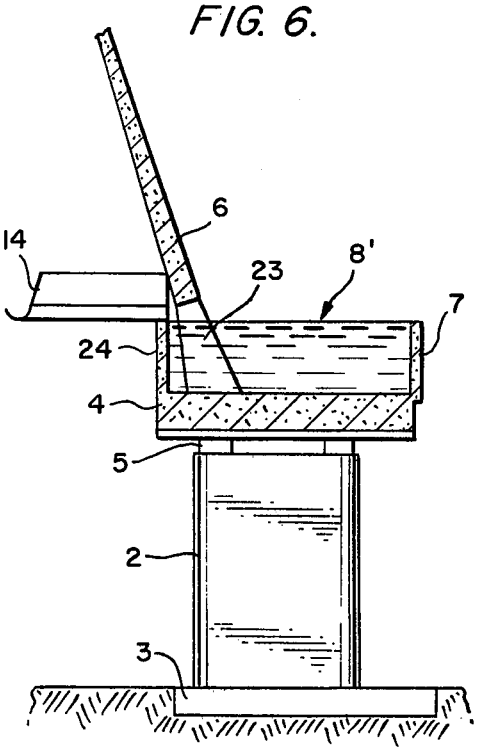
FIG. 6 is a sectional view of the same type as that of FIG. 4, but concerning a modification of the invention.

FIG. 6 shows another embodiment of the invention. In this embodiment, the shell 6 rests on the peripheral lintel 4 through pillars 23 which are evenly spaced apart. The lintel 4 then includes in its upper part an inner flange 24 located inside the cooler within the vertical from the base of the shell 6 and forming with the lintel proper and the outer flange 7*a* peripheral pan 8'. This embodiment enables the peripheral tank 17 to be eliminated.

Figure 7:
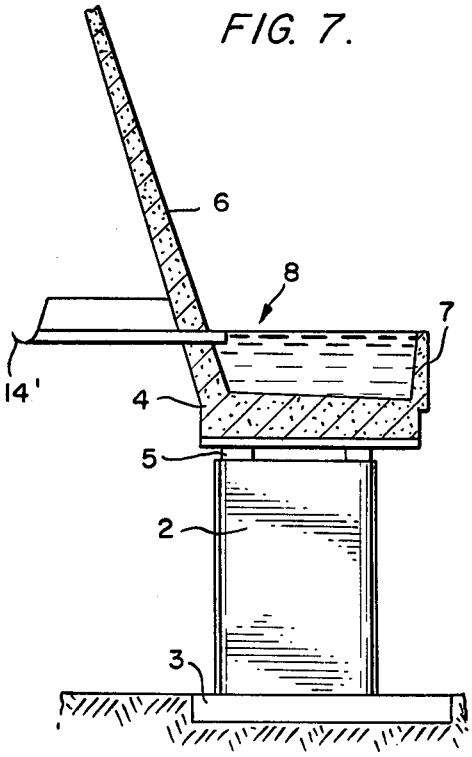
FIG. 7 is a sectional view of the same type showing another modification of the invention.

FIG. 7 shows another embodiment of the flow of the cooled liquid from the channels 14' to the peripheral pan 8. In this embodiment, the channels 14' extend through the wall of the shell and open onto the pan 8. The peripheral tank and the central collector are eliminated and the slope of the channels 14' is in the opposite direction, i.e., their lower outlet is adjacent to the shell 6.

As already mentioned, the cooler according to the present invention has many advantages over the prior art.

Firstly, the cooled liquid which is present in the peripheral pan 8 contributes to the even distribution of the forces on the various piles 2. Moreover, the cooled liquid which arrives in the peripheral pan 8 protects the lintel from sudden thermal variations and thus avoids the formation of cracks in the lintel. The same is true to a certain extent of the lower part of the shell 6 whose inner wall receives the running water and whose outer wall is heated by the cooled liquid and the steam which still emanates therefrom. As other particular advantages, there may be mentioned:

- an improved efficiency of the cooler owing to an improved supply of air to the elements 12 of the central zone;
- the elimination of water outlet pipes under the cooler and of the central cooled water pan;
- elimination of the frustoconical banks supporting the cold water pans conventionally employed;
- accessability of the regulating means such as the cofferdams;
- simplification of the by-pass systems permitting in particular a rapid stoppage of the streaming of the water in extremely cold periods;
- possibility of elimination of the peripheral inner tanks when employing the embodiment shown in FIG. 6;
- possibility of the elimination of the cooled liquid collectors when employing the embodiment shown in FIG. 7.

It may therefore be considered that a cooler according to the present invention is much cheaper to construct than those existing at the present time. Moreover, it operates much more easily.

I claim:

1. A cooler employing the air of the atmosphere and a streaming liquid of the type comprising a shell resting on piles which are independent and evenly spaced apart on its periphery and, disposed inside said shell, a distribution system for a liquid to be cooled, liquid-gas contacting units extending under the distribution system and receiving devices for the liquid from the liquid-gas contacting means including channels, disposed under the contacting unit, characterised in that the shell of the cooler rests on the piles through a wide peripheral lintel which has in its upper surface an inner flange and an outer flange defining a peripheral pan in which the cooled liquid collected in the channels is discharged by gravity.

2. A cooler according to claim 1, characterised in that the inner flange of the peripheral pan is formed by the lower part of the shell.

3. A cooler according to claim 2, charaterised in that the shell supports an inner peripheral tank communicating with the peripheral pan.

4. A cooler according to claim 1, characterised in that the shell rests on the peripheral lintel through pillars and the inner flange of the peripheral pan is located inside the cooler within the vertical from the base of the shell.

5. A cooler according to claim 1, characterised in that the channels extend through the wall of the shell and open onto the peripheral pan.

6. A cooler according to claim 1, characterised in that the distribution system for the liquid to be cooled comprises channels which extend from the center of the cooler and are provided with lateral distribution tubes for the liquid to be cooled, said channels extending through the wall of the shell, and having outlets above the peripheral pan, and the ends of the channels are provided with by-pass valves.

* * * * *